US006481533B1

(12) United States Patent
Iwasa

(10) Patent No.: US 6,481,533 B1
(45) Date of Patent: Nov. 19, 2002

(54) SINGLE INVERTER CONTROLLER FOR ELEVATOR HOIST AND DOOR MOTORS

(75) Inventor: Masao Iwasa, Chiba-ken (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/889,440

(22) PCT Filed: Feb. 18, 2000

(86) PCT No.: PCT/US00/04119

§ 371 (c)(1),
(2), (4) Date: Jul. 12, 2001

(87) PCT Pub. No.: WO00/50329

PCT Pub. Date: Aug. 31, 2000

(51) Int. Cl.[7] ..... B66B 1/28
(52) U.S. Cl. ..... 187/296; 187/316
(58) Field of Search ..... 187/290, 296, 187/284, 291, 316; 318/798–815; 307/66, 77

(56) References Cited

U.S. PATENT DOCUMENTS

| | | | | | |
|---|---|---|---|---|---|
| 4,478,315 | A | * | 10/1984 | Nomura | 187/296 |
| 4,527,663 | A | * | 7/1985 | Nomura | 187/296 |
| 4,904,918 | A | * | 2/1990 | Bailey et al. | 318/759 |
| 5,139,113 | A | * | 8/1992 | Mizuno et al. | 187/277 |
| 5,290,975 | A | * | 3/1994 | Mizuno et al. | 187/247 |
| 5,548,198 | A | * | 8/1996 | Backstrand | 212/285 |

* cited by examiner

*Primary Examiner*—Jonathan Salata

(57) ABSTRACT

A single inverter (8) provides variable frequency, variable voltage current output (11) to either a hoist motor (3) or a door motor (6), depending on the operating mode of the elevator car (1). A controller (9) provides an input signal (12) to an actuator (10) for switching the output current (11) between the motors (3, 6) by a relay switch (12). The controller (9) includes separate control profiles depending upon which motor (3, 6) is connected to the inverter (8).

4 Claims, 1 Drawing Sheet

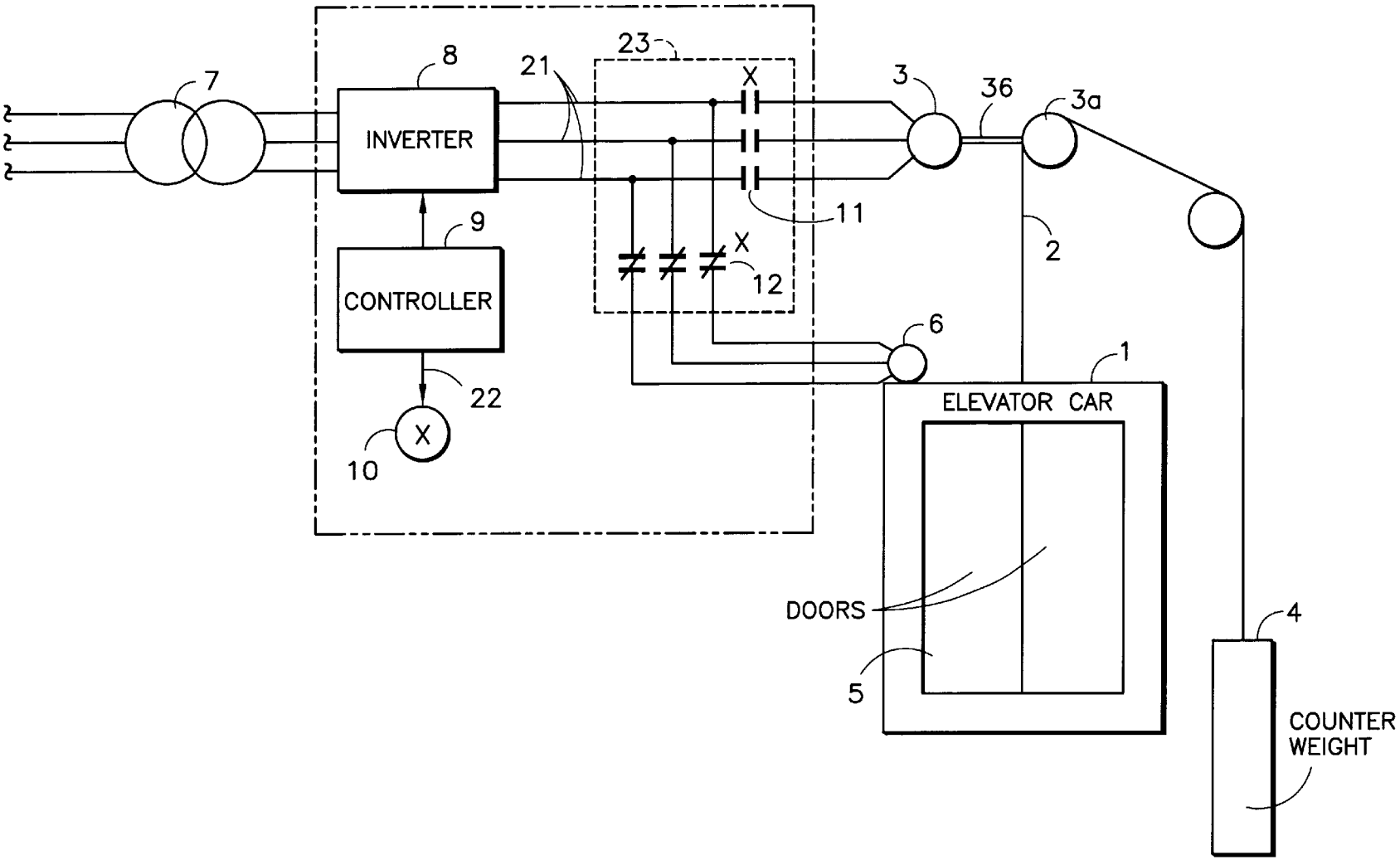
COUNTER WEIGHT
4
ELEVATOR CAR
1
2
3a
36
3
6
DOORS
5
11
12
23
21
INVERTER
8
CONTROLLER
9
22
10
7

SINGLE INVERTER CONTROLLER FOR ELEVATOR HOIST AND DOOR MOTORS

TECHNICAL FIELD

This invention involves an elevator in which the elevator hoist motor and the door motor utilize controlled alternating current power.

BACKGROUND

Elevator cars are typically moved by a hoist motor and the car doors are opened and closed by a door motor. The proper voltage and frequency current is provided by a hoist motor inverter to the hoist motor based on instructions from a hoist motor controller, and the proper voltage and frequency current is provided to the door motor by a door motor inverter based on command input from a door motor controller.

There are instances where the hoist motor and the door motor are operated simultaneously to increase a car's operating efficiency. For example, immediately before the car reaches or leaves a floor, the door motor is driven along with the hoist motor. Also, releveling (aligning the floor of the car with the floor at the entrance) may be performed while doors are opened.

Thus, while high performance, general-use elevators may require that the hoist motor and the door motor be driven simultaneously to increase operating efficiency, certain home elevator applications do not require high operating efficiency. For such elevators, the need to provide separate hoist motor inverters and door motor inverters has contributed to the cost of the product.

What is needed is a means for decreasing the overall cost of a home elevator, or the like.

SUMMARY OF THE INVENTION

In order to accomplish this purpose, this invention is equipped with a hoist motor that moves a car, a door motor that opens and closes the car door or doors, an inverter section that simultaneously controls the voltage and frequency of the current provided to the hoist motor and the door motor, and a control section that sends instructions to this inverter section to control the speed at which the car travels and the speed at which the door opens and closes. It is constituted so that the proper voltage and frequency current will be provided to the hoist motor from the inverter section until the car reaches a floor; and, after the car reaches a floor, the proper voltage and frequency will then be provided to the door motor from the same inverter section.

BRIEF DESCRIPTION OF THE FIGURES

FIG. 1 is a block diagram that shows one application example of an elevator associated with this invention.

DETAILED DESCRIPTION

Referring to FIG. 1, elevator car 1 is driven in a hoistway (not shown) and includes a horizontally sliding door 5 driven by door operator motor 6. The car 1 is positioned vertically by means of a rope 2 attached to the car 1 and suspended from the elevator drive sheave 3*a*. The rope 2 terminates at its other end at a counter weight 4 which provides a balancing of the vertical forces on the car 1. Drive sheave 3*a* is rotated by hoist motor 3 which turns an intermediate shaft 3*b* as shown.

Both the hoist motor 3 and the door motor 6 are variable voltage alternating current motors which may be precisely controlled for speed and position by varying the voltage and frequency of the supplied motor current.

According to the present invention, three phase variable frequency alternating current is supplied to either the hoist motor 3 or the door motor 6 by a controlled inverter section 8 which receives fixed voltage alternating current from a power source 7, such as an electric utility supply line. The voltage and frequency of the output current on lines 21 from the inverter section 8 is controlled in response to the inputs from a controller 9 as shown in the figure.

During vertical movement of the elevator car 1, doors 5 are closed and the inverter section 8 supplies variable frequency and voltage current to the hoist motor 3, only. The speed and position of the car 1 are controlled by the controller 9 so as to precisely deliver the elevator car, and its passengers, to the desired floor in the building served by the elevator. Upon arriving at the desired floor level, controller door 9 causes the elevator hoist motor 3 the cease operation and initiates a signal 22 to a relay control 10 actuating the power relay 12. Power relay 12 is operated, in response to the actuator 10, to switch the output 11 of the inverter section 8 from the hoist motor 3 to the door motor 6. After the inverter 8 is connected to the door motor 6, controller 9, using a completely different velocity profile, drives the door motor 6 to open the doors to permit ingress and egress of the passengers to the elevator car 1.

It would be appreciated by those skilled in the art that the control signals provided to the inverter 8 by the controller 9 will differ in response to the controllers selection of either the hoist motor or the door motor for receiving the inverter output 11. Thus, a single inverter 8 and controller 9 may be used to control both a hoist motor 3 and a door motor 6 in an elevator application. Switching relay 11 prevents the simultaneous connection of the hoist motor 3 and the drive motor 6 to the inverter 8.

The system according to the present invention thus eliminates the need for a second inverter and controller as is known in the prior art, in exchange for the requirement that the single remaining inverter 8 drive only one of the hoist motor and the door motor at a given time.

In the event the elevator car were to become misleveled during a period of time in which the door motor 6 was in operation or the doors 5 in an open position, a controller 9, sensing the misleveling of the elevator with the desired floor, would direct inverter 8 to power door motor 6 so as to close doors 5, then command actuator 10 to actuate the relay 12 so as to connect the inverter 8 to the hoist motor 3 and disconnect inverter 8 from door motor 6. The controller 9 would then control the inverter 8 so as to drive hoist motor 3 to position the elevator car 1 at the correct position within the hoistway.

Relay 12, shown here schematically as a mechanical relay having a mechanical actuator 10, may alternatively be an electronic switch or any other device or structure which can divert the output 11 of the inverter section 8 between either the hoist motor 3 or the door motor 6, in response to signal 22 from the controller 9.

What is claimed is:

1. Means for providing variable frequency alternating current for driving an elevator hoist motor and an elevator door motor, comprising:

a controller for controlling the elevator hoist motor to position an elevator car with a hoistway and for controlling the elevator door motor to open and close an elevator door;

a single inverter section for receiving alternating current from a supply source and delivering variable frequency, variable voltage driving current in response to a control signal received from the controller;

means for switching the variable frequency, variable voltage current delivered by the inverter between the hoist motor or the door motor; and means responsive to a second signal from the controller for causing the switch means to connect the inverter output to either the hoist motor or the door motor individually wherein the controller initiates the second signal upon sensing the elevator car has reached a desired landing, and wherein the controller initiates the second signal upon sensing the elevator car is misleveled to cause the means for switching to connect the inverter to the hoist motor.

2. The means for providing variable frequency alternating current as recited in claim 1, wherein the controller includes a first control profile for use only when the inverter output is connected to the hoist motor, and a second control profile for use only when the inverter output is connected to the door motor.

3. The means for providing variable frequency alternating current as recited in claim 2 wherein said controller automatically switches from the first profile to the second profile when the inverter is connected to the door motor.

4. The means for providing variable frequency alternating current as recited in claim 1 wherein said controller automatically switches from the second profile to the first profile when the inverter is connected to the hoist motor.

* * * * *